US005159827A

United States Patent [19]

Shiraishi et al.

[11] Patent Number: 5,159,827

[45] Date of Patent: Nov. 3, 1992

[54] TRANSFERRING APPARATUS FOR TRANSFER PRESS

[75] Inventors: Motoatsu Shiraishi; Tatsuo Nagamitsu; Mitsuki Nakamura, all of Sayama, Japan

[73] Assignee: Honda Giken Kogyo Kabushiki Kaisha, Tokyo, Japan

[21] Appl. No.: 686,458

[22] Filed: Apr. 17, 1991

[30] Foreign Application Priority Data

Apr. 19, 1990 [JP] Japan ..... 2-104141
Aug. 22, 1990 [JP] Japan ..... 2-220749

[51] Int. Cl.[5] ..... B21D 43/05
[52] U.S. Cl. ..... 72/405; 198/621
[58] Field of Search ..... 72/405, 421, 422; 198/621; 414/752, 750, 225, 625

[56] References Cited

U.S. PATENT DOCUMENTS 4,589,819 5/1986 Shirao ..... 414/752
4,995,505 2/1991 Takahashi ..... 414/752

FOREIGN PATENT DOCUMENTS 232847 2/1986 German Democratic Rep. ... 72/405
61-235310 10/1986 Japan .
262031 10/1989 Japan ..... 72/405
2175868 12/1986 United Kingdom .
2223973 4/1990 United Kingdom .
2227697 8/1990 United Kingdom .

*Primary Examiner*—Daniel C. Crane
*Attorney, Agent, or Firm*—Armstrong & Kubovcik

[57] ABSTRACT

A transferring apparatus for a transfer press machine which includes a plurality of working stations disposed in a work-transferring direction and provided with lower dies and upper dies cooperating to press workpieces, so that the workpieces are sequentially transferred between the working stations. A plurality of sets of pairs of left and right carriages are associated with one of the working stations. The spacings between adjacent twos of the sets of the carriages are adjusted in said transferring direction during operation. At least one cross bar is mounted to extend between the left and right carriages of each set and has suction cups mounted on an intermediate portion thereof for holding the workpiece. The cross bar is cyclically movable in the transferring direction and in a vertical direction. A pair of left and right guide bars vertically movably are mounted to extend along opposite sides of the working stations to provide the cyclic motion of the cross bar. A pair of left and right feed plates are supported on the guide bars for movement in the transferring direction. The structure for adjusting supports the carriages on said feed plates so that their positions can be adjusted. Alternatively, feed plates are supported for movement in the transferring direction on a pair of left and right guide bars which are fixedly mounted to extend along opposite sides of the working stations to provide the cyclic motion of the cross bar. The carriages are supported on the feed plates respectively so that their positions can be adjusted with the cross bar being vertically movably supported on said carriages.

4 Claims, 11 Drawing Sheets

TRANSFERRING APPARATUS FOR TRANSFER PRESS

BACKGROUND OF THE INVENTION

The present invention relates to a transferring apparatus for a transfer press machine which includes a plurality of working stations. The working stations are provided with lower dies and upper dies cooperating to press workpieces, and arranged in a workpiece transferring direction. The apparatus sequentially transfers the workpieces between the working stations.

A conventionally known transferring apparatus of such type for a transfer press machine is known from Japanese Patent Application Laid-open No. 235310/86. This publication discloses a plurality of pairs of left and right carriages supporting opposite ends of cross bars which include suction cups for holding the workpieces. The carriages are supported on a pair of guide rails vertically movably disposed on the left and right sides of the working stations, so that cyclic motion comprising a longitudinal movement and a vertical movement is provided to the cross bars to sequentially transfer the works which are held by the suction cups.

In general, the working stations in the transfer press machine are disposed at equal distances, but in some cases, it is necessary to change some of the spacings between the working stations. However, in the above prior art transferring apparatus, the spacing between the sets of carriages in the transferring direction, i.e., the spacing between the cross bars including the suction cups are constant. It is impossible to accommodate to the press machine in which the working stations are disposed at non-uniform distances.

OBJECT AND SUMMARY OF THE INVENTION

The present invention has been accomplished with the above circumstances in view, and it is an object of the present invention to provide a transferring apparatus for a transfer press machine, wherein a workpiece can be transferred between the working stations disposed at unequal or non-uniform distances.

To achieve the above object, a first aspect of the present invention resides in a transferring apparatus for a transfer press machine which includes a plurality of working stations, the working stations provided with lower dies and upper dies cooperating to press workpieces, and arranged in a workpiece transferring direction, the apparatus sequentially transferred between the working stations. The inventive apparatus further includes a plurality of pairs of left and right carriages in association with the working stations, the spacings between adjacent pairs of the carriages being adjustable in the transferring direction, and a cross bar mounted to extend between the left and right carriages and having suction cups mounted on an intermediate portion thereof for holding the workpieces, the cross bar being capable of conducting a transferring motion comprising a combination of a longitudinal movement in the transferring direction and a vertical movement.

In addition, a second aspect of the present invention resides in that as means for providing the transferring motion of the cross bar, a pair of left and right guide bars are vertically movably mounted to extend along opposite sides of the working stations, and a pair of left and right feed plates are supported on the corresponding guide bars for movement in the transferring direction, the carriages being supported on the feed plates respectively so that their positions can be adjusted.

Further, a third aspect of the present invention resides in that as means for providing the transferring motion of the cross bar, feed plates are supported for movement in the transferring direction on a pair of left and right guide bars which are fixedly mounted to extend along opposite sides of the working stations, the carriages being supported on the feed plates respectively so that their positions can be adjusted, the cross bar being vertically movably supported on the carriages.

According to the first aspect of the present invention, the workpieces are sequentially transferred between the adjacent working stations by the transferring motion of the cross bar (including the suction cups for holding the workpiece) in the transferring direction and in the vertical direction. In such case, even when the spacings between the adjacent working stations are not constant, the spacing between the carriages mounted in association with the working stations can be adjusted in the transferring direction to change the spacing between the cross bars, thus easily dealing with the working stations disposed at unequal or non-uniform distances.

According to the second and third aspects of the present invention, the transferring motion of the cross bar can be realized by supporting the feed plates movable in the transferring direction on the vertically movable guide bars and supporting the carriages with the cross bar mounted to extend therebetween on the feed plates, or by supporting the feed plates movable in the transferring direction on the guide bars fixedly mounted and supporting the guide bars for vertical movement on the carriages supported on the feed plates.

BRIEF DESCRIPTION OF THE DRAWINGS

The above and other objects and the attendant advantages of the present invention will become readily apparent by reference to the following detailed description when considered in conjunction with the accompanying drawings wherein:

FIG. 1 to 6 illustrate a first embodiment of the present invention, wherein FIG. 1 is a side view of the entire transfer press machine of the first embodiment;

FIG. 2 is a plan view taken along an arrow II—II in FIG. 2;

FIG. 3 is an enlarged view of essential portions shown in FIG. 2;

FIG. 4 is a view taken along an arrow IV in FIG. 3;

FIG. 5 is a sectional view taken along a line V—V in FIG. 4; and

FIG. 6 is a view for explaining the operation;

FIGS. 8 to 12 illustrate a third embodiment of the present invention, wherein FIG. 8 is a side view of the entire transfer press machine of the third embodiment;

FIG. 9 is a plan view taken along an arrow IX—IX in FIG. 8;

FIG. 10 is an enlarged view of essential portions shown in FIG. 9;

FIG. 11 is a view taken along an arrow XI in FIG. 10; and

FIG. 12 is a sectional view taken along a line XII—XII in FIG. 10.

DETAILED DESCRIPTION OF PREFERRED EMBODIMENTS

The present invention will now be described with reference to the accompanying drawings and in connection with embodiments.

FIGS. 1 to 6 illustrate a first embodiment of the present invention.

Figure 1:
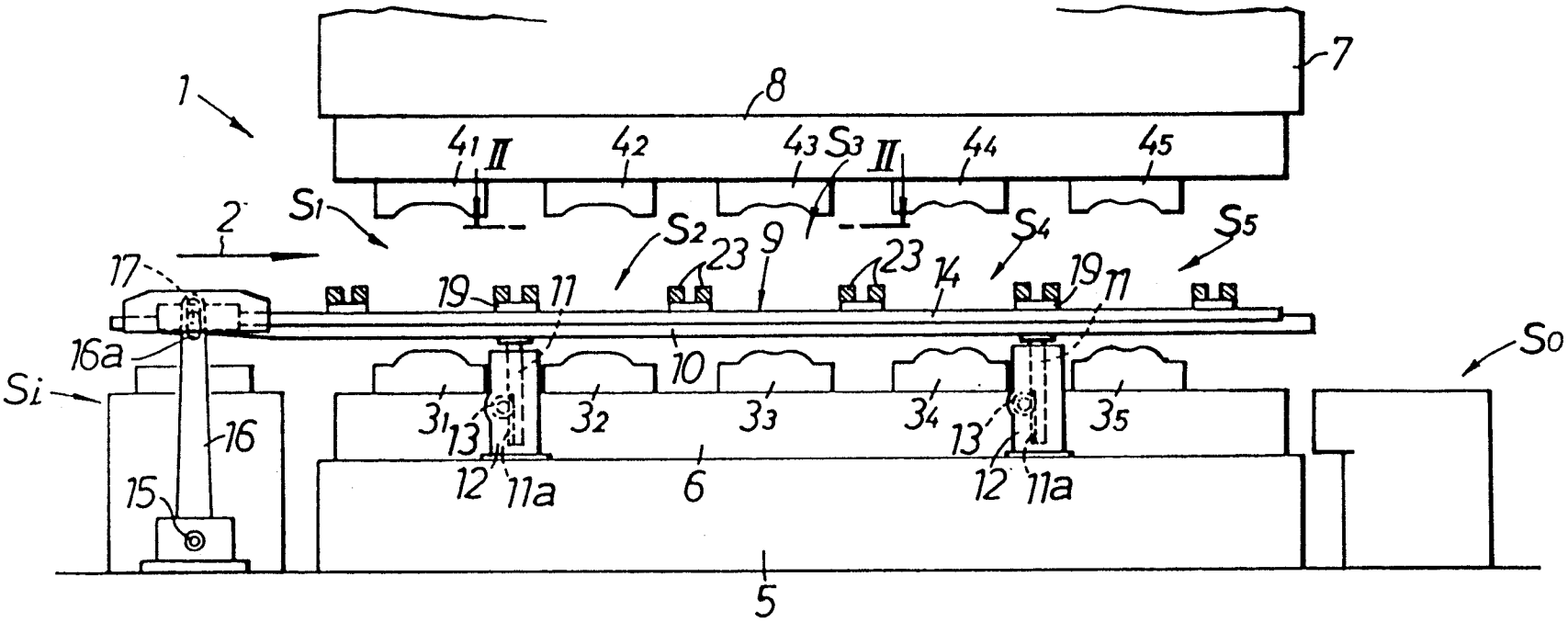

As shown in FIG. 1, a press machine 1 has a plurality of working stations, e.g., first to fifth stations S1 to S5, arranged in a workpiece transferring direction 2. Lower dies $3_1$ to $3_5$ and upper dies $4_1$ to $4_5$ cooperating to press workpieces W are disposed in the working stations S1 to S5, respectively. The lower dies $3_1$ to $3_5$ are fixed to a bolster 6 of a base 5 at predetermined distances spaced from one another in the transferring direction 2. The upper dies $4_1$ to $4_5$ are supported on a bolster 8 fixed to a lifting stand 7 in association with and directly opposing the lower dies $3_1$ to $3_5$. A transferring apparatus 9 is provided in the press machine 1 and is operated to transfer the workpieces after pressing of the workpieces by the lower dies $3_1$ to $3_5$ and the upper dies $4_1$ to $4_5$. More specifically, the workpieces are sequentially transferred by the transferring apparatus 9 from a take-in station Si at the rear end in the transferring direction 2 through the working stations S1 to S5 to a take-out station So at the front end for every pressing operation of the press machine 1.

The transferring apparatus 9 comprises a pair of left and right guide bars 10, 10 disposed along the workpiece transferring direction 2 on opposite sides of the take-in station Si, the working stations S1 to S5 and the take-out station So. A support rod 11 is mounted on an underside of the guide bar 10 and vertically movably supported on a support post 12. The support bar 11 has a rack 11*a* on a side surface. A pinion 13 meshed with the rack 11*a* is driven for reciprocal rotation so as to lift and lower the left and right bars 10, 10. A feed plate 14 is slidably supported on each of the left and right guide bars 10, 10 over substantially the entire length thereof for sliding movement in a longitudinal direction, i.e., in the transferring direction 2. An elongated hole 16*a* is defined in an upper end of a swingable arm 16 secured at its lower end to a drive shaft 15 which is rotated reciprocally. A pin 17 mounted on one end of each feed plates 14, 14 is engaged in the elongated hole 16*a*. Thus, the feed plates 14, 14 are cyclically moved through a closed path by the lifting movement of the guide bars 10, 10 caused by the reciprocal rotation of the pinion 13 and the longitudinal movement of the feed plates 14, 14 by the reciprocal rotation of the drive shaft 15.

As shown in FIG. 2 to 5, the guide bar 10 is made of a steel material having a I-shaped section. Each of the feed plates 14, 14 having a C-shaped section is relatively movably supported on the guide bar 10 through upper and lower rollers 18 mounted at a plurality of points on each of opposite side surfaces of the guide bar 10. Six sets of pairs of left and right carriages 19, 19 are mounted on the upper surfaces of the feed plates 14 in association with the five working stations S1 to S5. Each of the carriages 19, 19 is made of a plate which is supported through a slider 21 on a guide rail 20 laid on an upper surface of the feed plate 14. The carriage 19 has a guide pin 19*a* slidably engaged in a guide groove 14*a* longitudinally provided in the feed plate 14. The carriage 19 is connected to a cylinder 22 mounted on the upper surface of the feed plate 14 and is movable in the transferring direction 2. The left and right carriages 19, 19 are interconnected by two cross bars 23, 23 mounted to extend in a lateral direction, i.e., in a direction perpendicular to the transferring direction 2. More specifically, a guide pin 23*a* mounted at an end of the cross bar 23 is slidably supported in a guide groove 19*b* provided in an upper surface of the carriage 19, and the cross bars 23, 23 are driven toward or away from each other by cylinders 24 mounted on the carriages 19, 19.

A slider 27 for supporting a stay 26 having two suction cups 25 for holding the workpiece W is slidably supported in each of two guide grooves 23*b* provided in a side surface of each of the cross bars 23, 23 and is connected to a cylinder 28 disposed within the cross bar 23 to move the suction cups 25 in the lateral direction.

Description will be made of the operation of the first embodiment having the above construction.

When the pressing is to be conducted in the working stations S1 to S5 by the lower dies $3_1$ to $3_5$ and the upper dies $4_1$ to $4_5$, six sets of the cross bars 23, 23 connecting the feed plates 14, 14 are on standby in positions between adjacent stations of the take-in station Si, the working stations S1 to S5 and the take-out station So (see FIG. 1). When the pressing of the workpiece W in each of the working stations S1 to S5 is completed and the upper dies $4_1$ to $4_5$ and the lower dies $3_1$ to $3_5$ are separated away from each other, the swingable arm 16 is driven to retreat the feed plates 14, 14 relative to the guide bars 10, 10, and the six sets of cross bars 23, 23 are positioned in their rear position above the take-in station Si and the working stations S1 to S5. Then, the support rod 11 is lowered, thereby lowering the guide bars 10, 10, the feed plates 14, 14 and the cross bars 23, 23 in unison, so that the workpieces W in the take-in station Si and the working stations S1 to S5 are attracted to and held by the suction cups 25 mounted on the cross bars 23, 23. Subsequently, the raising movement of the guide bars 10, 10, the advancing movement of the feed plates 14, 14 and the lowering movement of the guide bars 10, 10 are conducted, so that the six sets of cross bars 23, 23 are shifted to a front position. The workpieces held by the suction cups 25 are released and placed at the working stations S1 to S5 and the take-out station So. Then, the six sets of cross bars 23, 23 are returned to the original standby positions by the raising movement of the guide bars 10, 10 and the retreating movement of the feed plates 14, 14 and thereafter, the pressing of the workpieces W is conducted by lowering the upper dies $4_1$ to $4_5$.

Figure 2:
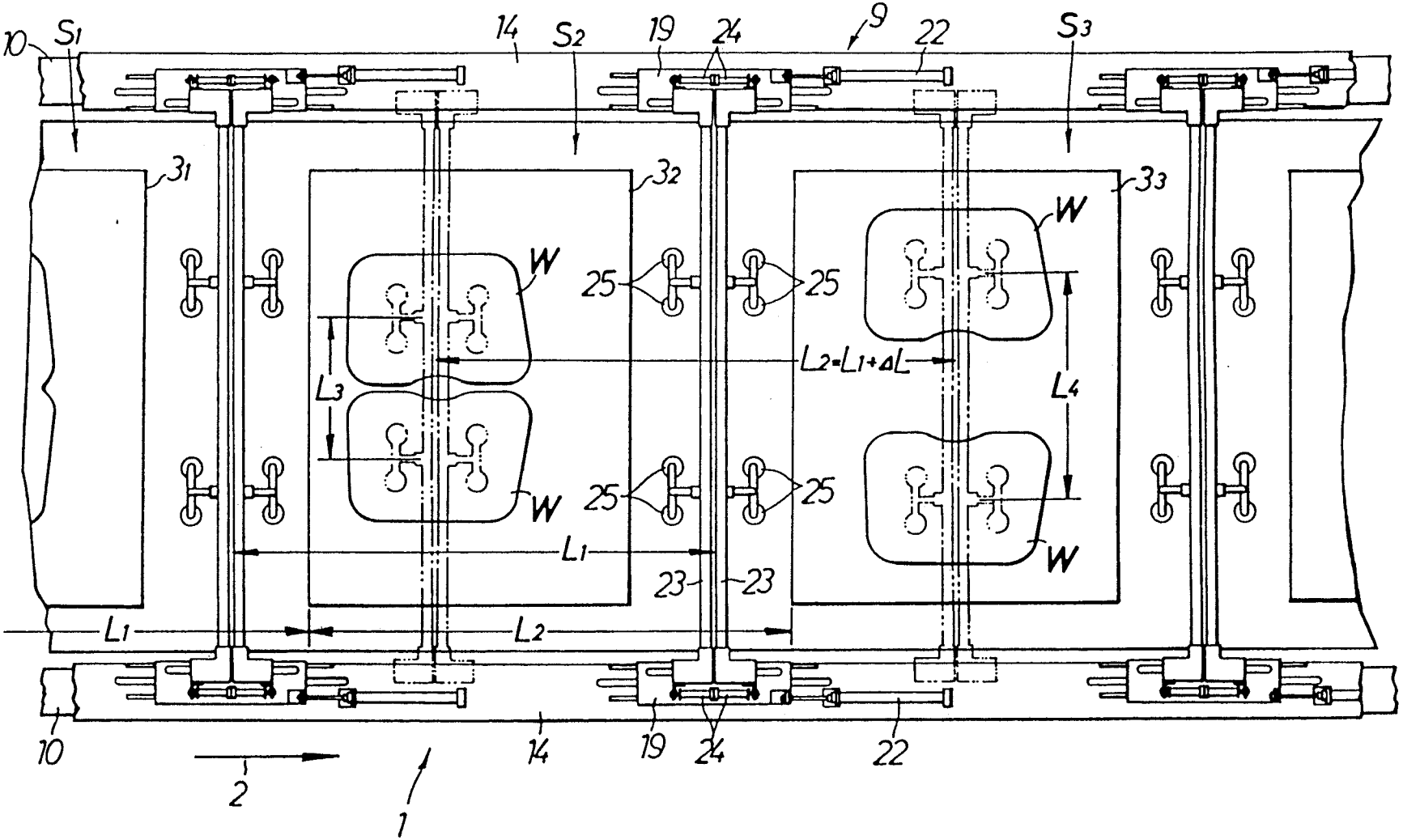
Figure 3:
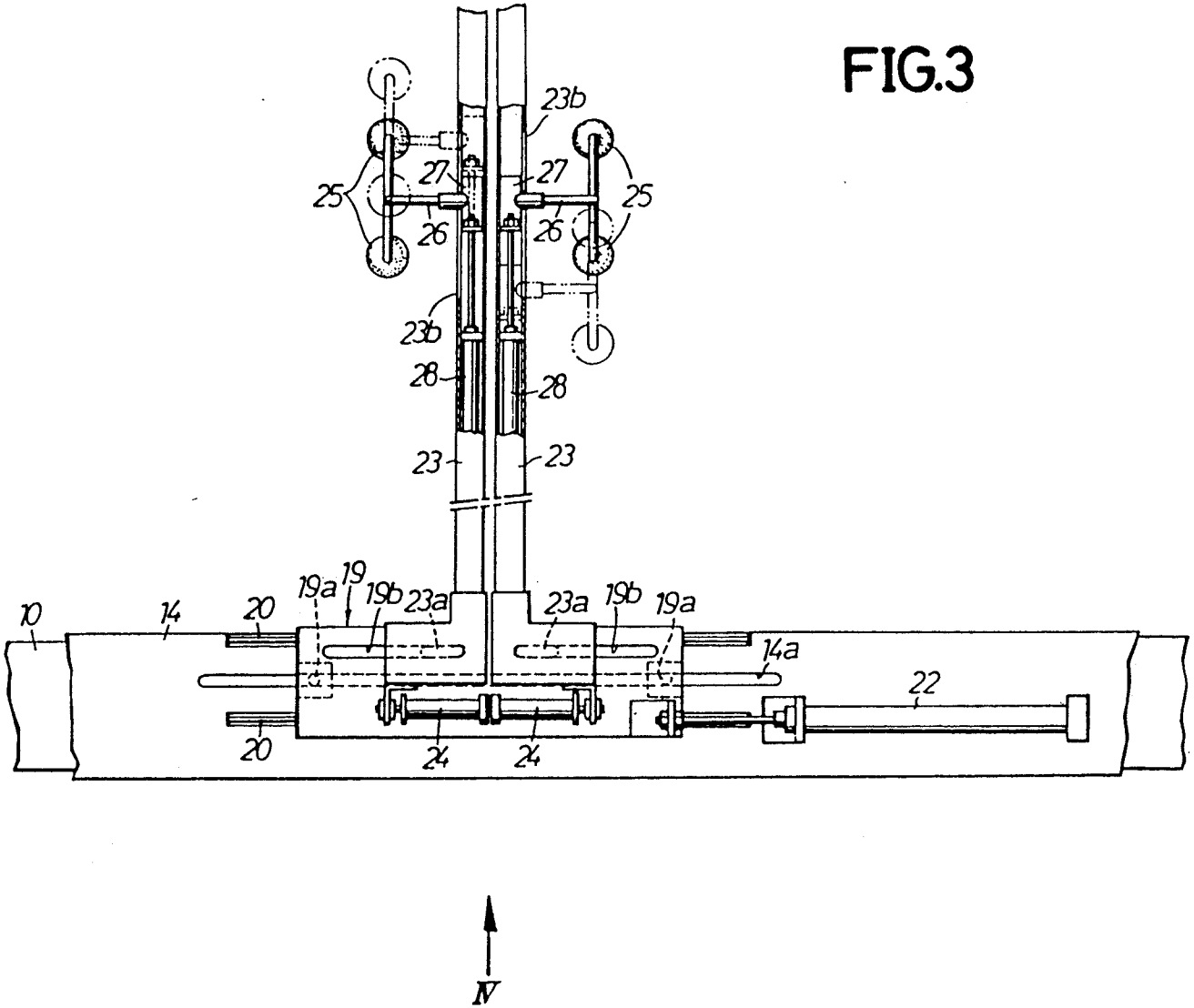
Figure 4:
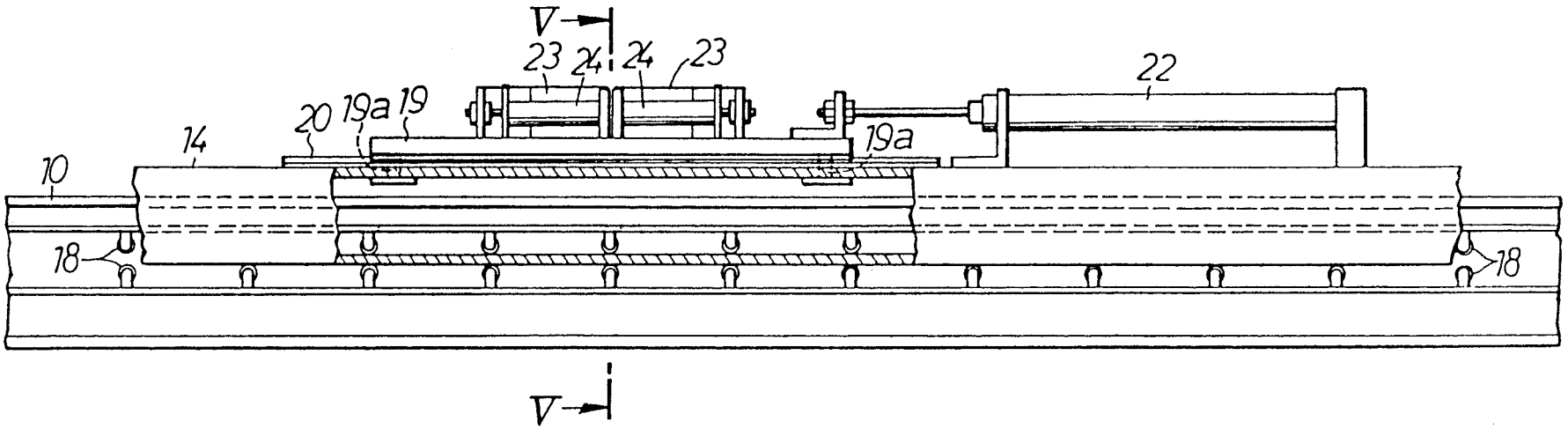
Figure 5:
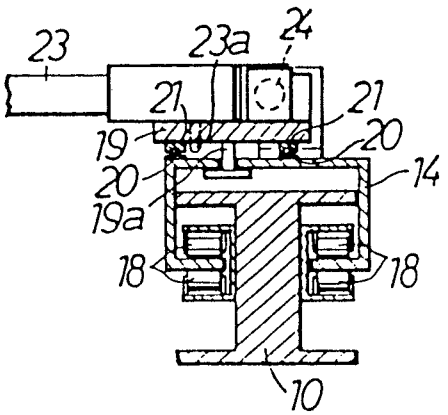

In such pressing, in the case that the working stations S1 to S5 are positioned with equal spacings L1, the longitudinal spacings between the carriages 19, 19 on the feed plates 14, 14 may be equalized to the such distance L1. However, for example, when a spacing L2 between the working station S2 in which trimming is conducted and the working station S3 in which piercing is conducted is larger than the spacing L1 between the working station S1 in which drawing is conducted and the working station S2 in which trimming is conducted, as shown in FIG. 2, the cylinders 22 are contracted to move the pair of left and right carriages 19, 19 on the feed plates 14, 14 in a rightward direction as viewed in Figures by a difference $\Delta L$ between the L2 and L1, while the feed plates 14, 14 are advanced to carry the workpiece W held by the suction cups 25 from the working station S2 to the working station S3. After the workpiece W is released on the lower die $3_3$ in the working station S3, the carriages 19, 19 are moved on the feed plates 14, 14 by a distance $\Delta L$ in the leftward direction as viewed in Figures to the original positions, while the feed plates 14, 14 are retreated. In this way, even when the spacings between adjacent working stations S1 to S5 are not constant, it is possible to easily accommodate the press to such condition by shifting the positions of the carriages 19, 19 relative to the feed plates 14, 14.

In concurrently carrying a pair of left and right workpieces W from the working station S2 for trimming to the working station S3 for piercing and when the spacing between the two workpieces W is required to be increased from L3 to L4, the left and right suction cups 25 may be separated from each other by the distance L4-L3 by driving the cylinder 28 while advancing the feed plates 14, 14.

Figure 6:
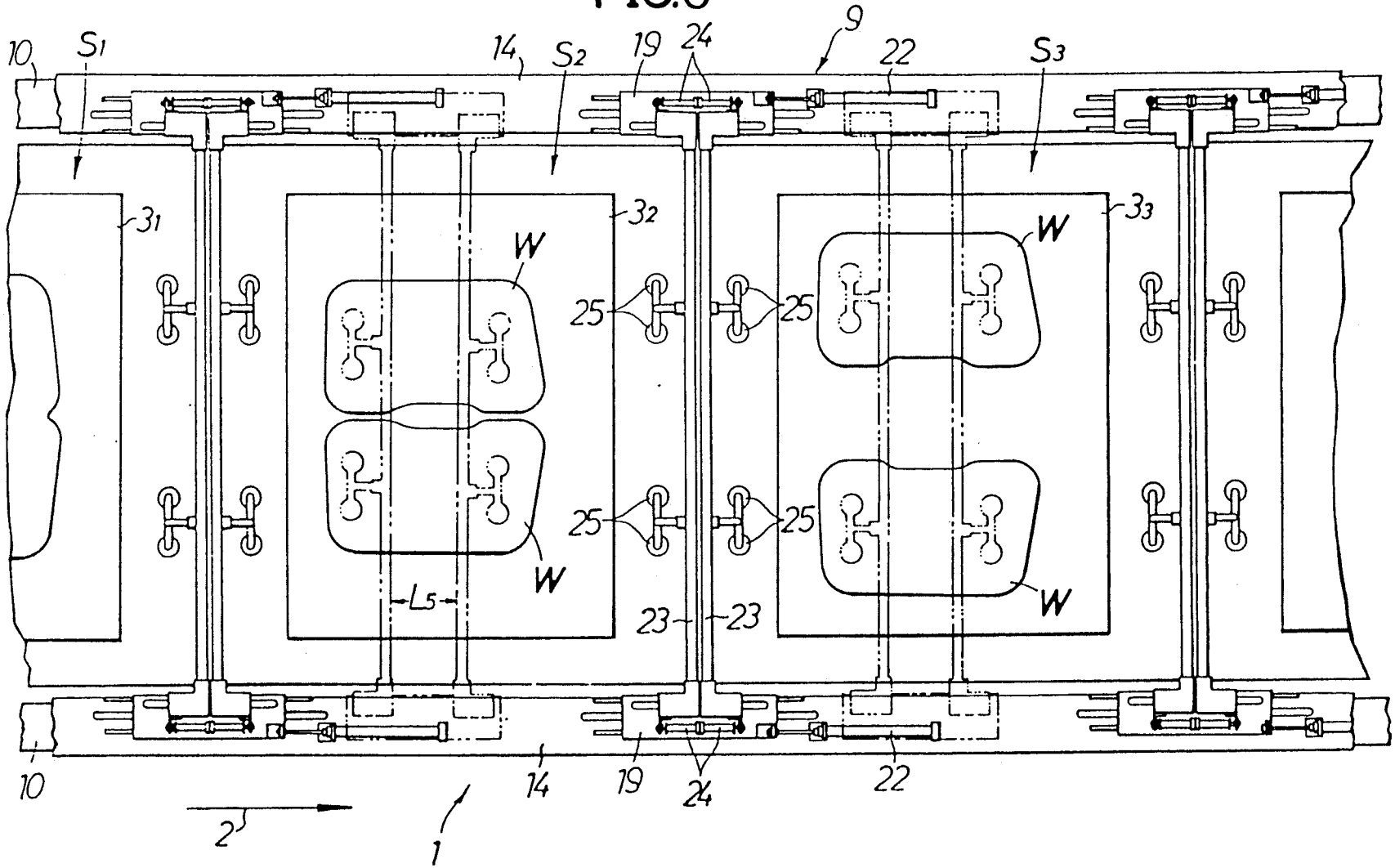

When a large-sized workpiece W is to be transferred, as shown in FIG. 6, the pair of cross bars 23, 23 supported on the carriages 19, 19 may be separated from each other by a distance L5 by expanding the cylinders 24. This increases the spacing between the suction cups 25 mounted on the cross bars 23, 23 to permit the holding of the peripheral portion of the workpiece W, thereby holding the workpiece W with a further reliability. In this case, when the cross bars 23, 23 lie in the standby position between the adjacent working stations, the interference with the upper dies $4_1$ and $4_5$ which are raised can be avoided by moving the cross bars 23, 23 toward each other. In addition, a workpiece W of a special shape such as parallelogramic shape can be reliably held by intentionally misaligning the positions of the suction cups 25 on the pair of cross bars 23, 23 in opposite directions, as shown by two-dotted chain lines in FIG. 3.

Figure 7:
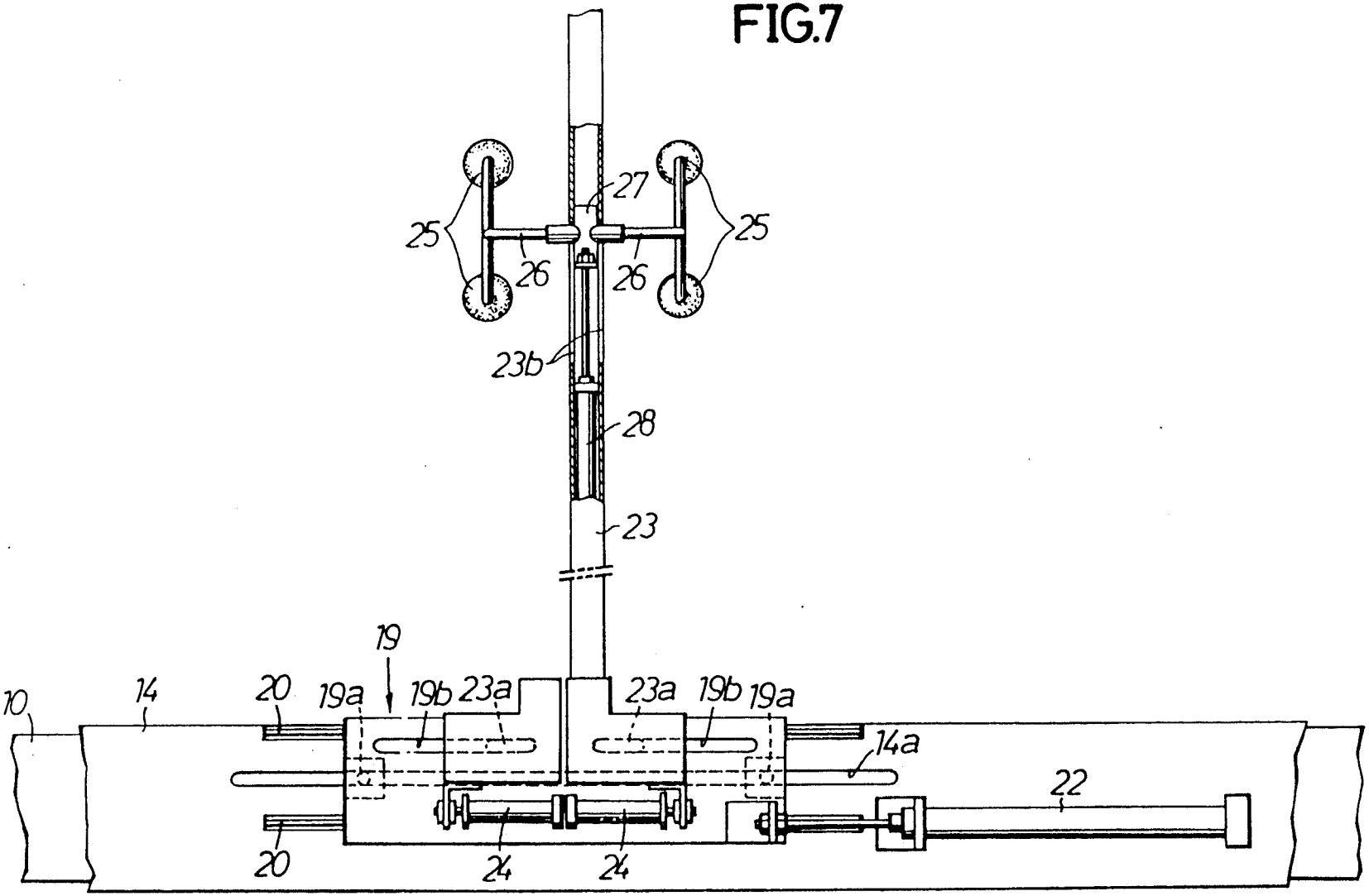
FIG. 7 illustrates a second embodiment of the present invention corresponding to FIG. 3.

FIG. 7 illustrates a second embodiment of the present invention, which has a feature that one of the two cross bars 23, 23 connecting the left and right carriages 19, 19 is eliminated, the remaining one having four suction cups 25 mounted thereon. This embodiment can be applied when the size of the workpieces is constant and there is no need for changing the spacing between the suction cups 25 in the transferring direction. The structure thereof can be simplified.

FIGS. 8 to 12 illustrate a third embodiment of the present invention. In this third embodiment, the components or parts corresponding to those in the previously described first embodiment are identified by the same reference characters.

Figure 8:
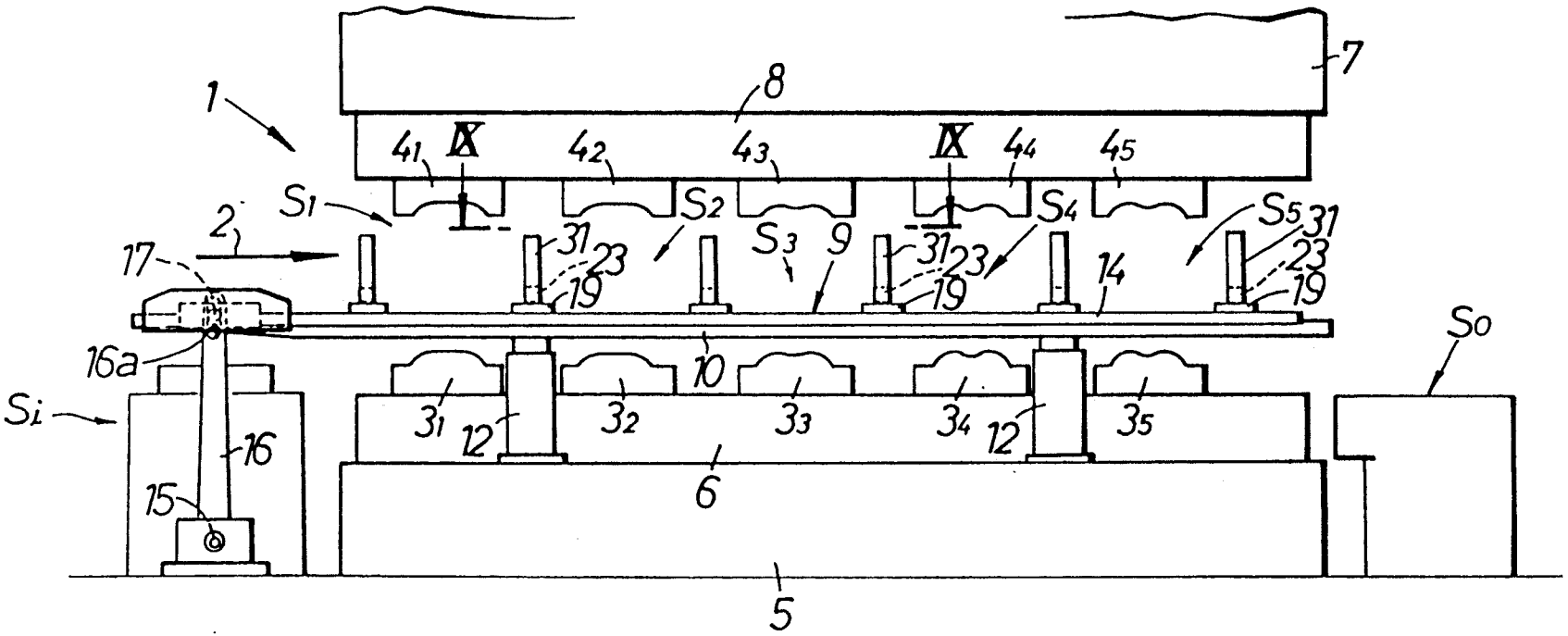
Figure 9:
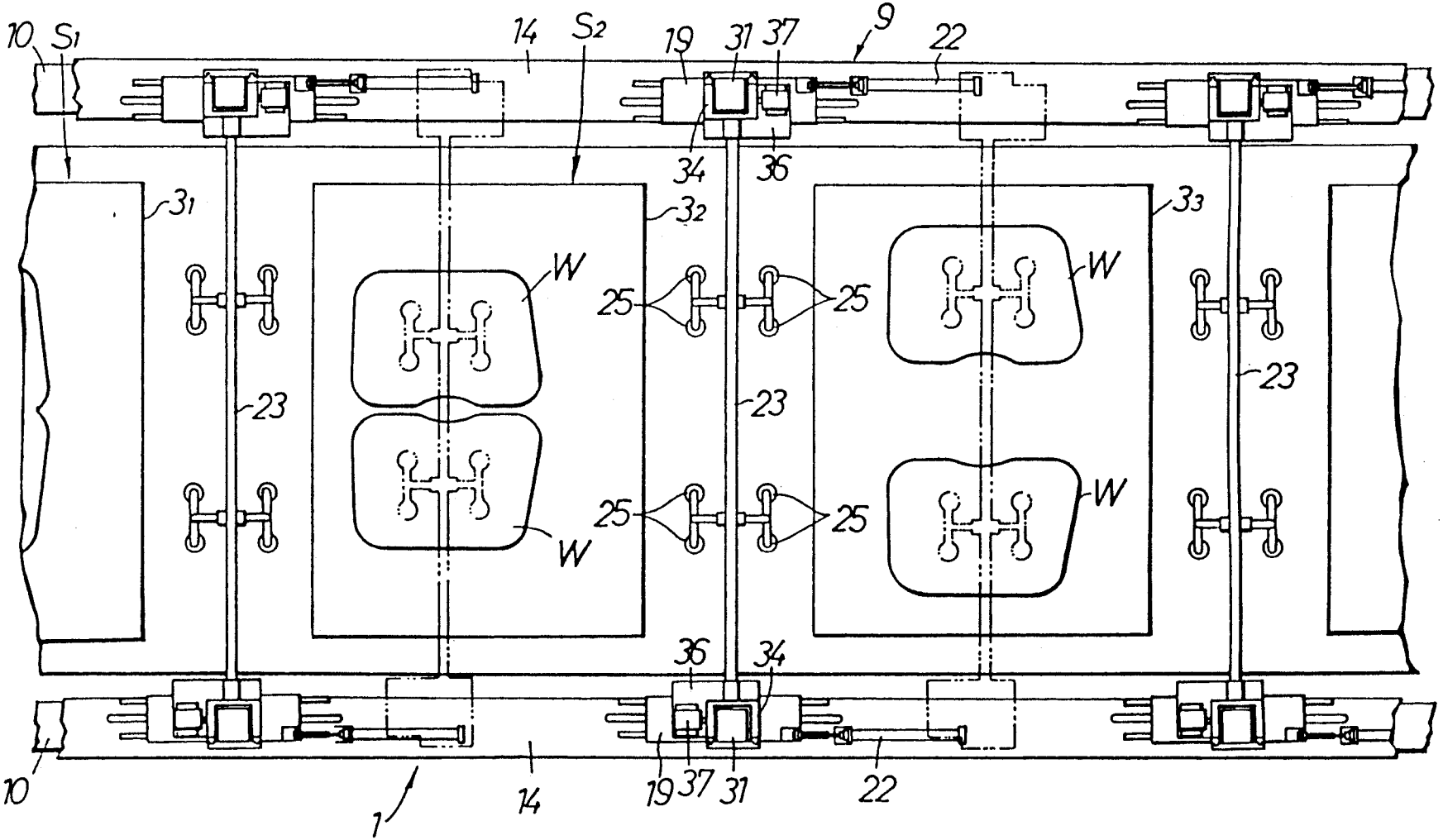

As shown in FIG. 8, the transferring apparatus 9 has guide bars 10, 10 secured to an upper end of the support post 12. Feed plates 14, 14 and are supported on the guide bars 10, 10, respectively, connected to a swingable arm 16 to be driven in the transferring direction 2. Referring also to FIG. 9, it is apparent that six sets of pairs of left and right carriages 19, 19 are mounted on the left and right feed plates 14, 14 and as in the previous embodiment, each of the carriages 19, 19 is connected to a cylinder 22, so that the spacing between the carriages in the transferring direction 2 can be freely adjusted. Guide posts 31 are vertically extended on each of the feed plates 14, 14, and cross bars 23 having suction cups 25 are supported for vertical movement along the guide posts 31.

Figure 10:
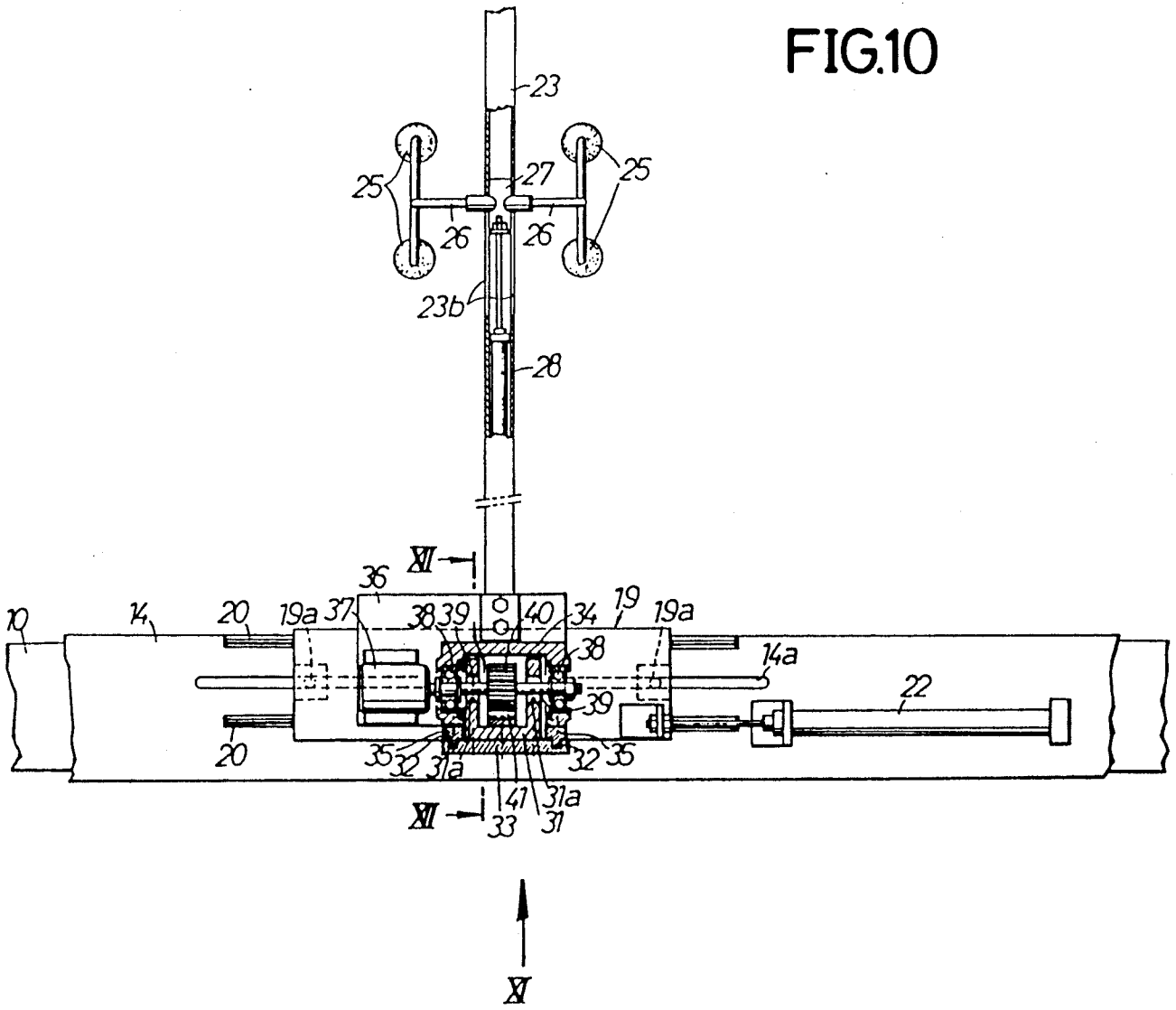
Figure 11:
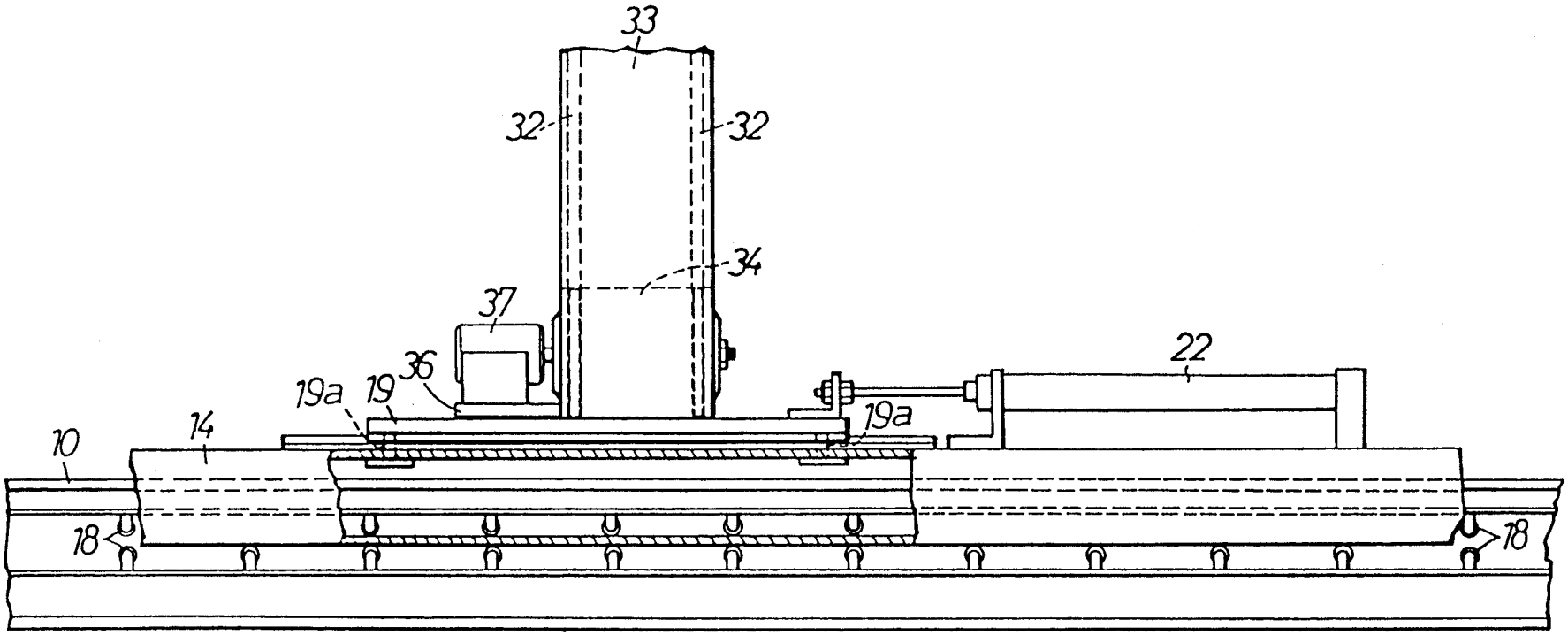
Figure 12:
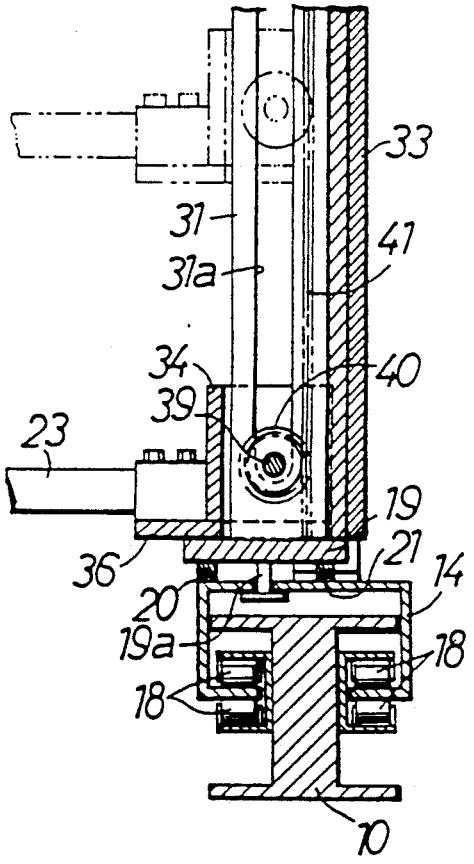

As shown in FIGS. 10 to 12, the guide post 31 is formed into a U-shape in cross section, and a guide plate 33 with a pair of guide grooves 32 is secured to a back of the guide post 31. A lift member 34 formed into a U-shape in cross section comprises a pair of sliders 35 slidably engaged in the guide grooves 32 and is provided with a support plate 36 integrally coupled to a lower portion thereof. A motor 37 is mounted on the support plate 36 and has an output shaft 39 supported on the lift member 34 with a ball bearing 38 interposed therebetween. The output shaft 39 extends through elongated holes 31*a* vertically extending in opposite side surfaces of the guide post 31. A pinion 40 secured to an intermediate portion of the output shaft 39 is meshed with a rack 41 fixedly mounted on an inner surface of the guide post 31. The suction cups 25 are supported on one cross bar 23 mounted to extend between the corresponding left and right support plates 36, so that the positions thereof can be adjusted in the lateral directions as in the previous embodiment.

In this embodiment, when the swingable arm 16 is driven, the feed plates 14, 14 supported on the guide bars 10 are moved in the transferring direction 2, with the result that the six sets of carriages 19, 19 supported on the feed plates 14, 14 are also moved all together in the transferring direction 2. When the motor 37 is driven to rotate the pinion 40 meshed with the rack 41, the support plate 36 supported through the lift member 34 on the guide post 31 vertically provided on each of the carriages 19 is vertically moved along with the motor 37, with the result that the cross bar 23 mounted to extend between the left and right support plates 36 is also vertically driven. If the cross bar 23 supported on the carriages 19, 19 is moved in the transferring direction 2 and at the same time vertically relative to the carriages 19, 19 in this manner by driving the feed plates 14, 14, the cross bar 23 can be cyclically moved to transfer the workpieces W between the individual stations S1 to S5. In such case, even when the stations S1 to S5 are disposed with non-uniform or unequal spacings as in the previous embodiment, the workpieces W can be transferred without hindrance by adjusting the positions of the carriages 19, 19 on the feed plates 14, 14 during such cyclic motion of the cross bar 23.

While the embodiments of the present invention have been described above in detail, it will be understood that the present invention is not limited to these embodiments, and various minor modifications and variable in design of the present invention can be made without departing from the scope of claims in the present invention.

For example, the cross bar 23 is vertically moved relative to the carriages 19, 19 in the third embodiment, but the carriages 19, 19 having the cross bar 23 integrally mounted thereon may be vertically moved.

In addition, while both members of the pair of cross bars 23, 23 are movably supported on the carriages 19, 19 in the first embodiment, one of the cross bars 23 may be movable and the other may be fixed to the carriage 19.

As discussed above, according to the first aspect of the present invention, in providing the transferring motion of the cross bars provided with the suction cups for holding the workpieces to transfer them between the working stations, the spacings between the cross bars supported on the carriages can be adjusted by changing the spacings between the plurality of sets of carriages disposed in the work-transferring direction. Consequently, even if the spacings between the adjacent working stations are non-uniform, this can be accommodated by displacing the positions of the cross bars in accordance with the non-uniform spacings between the working stations.

In addition, according to the second and third aspects of the present invention, the movement of the cross bars in the transferring direction and the movement thereof in the vertical direction are independently conducted and hence, such movements are simplified, leading to a simplified structure of the driving mechanism.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A transferring apparatus for a transfer press machine which includes a plurality of working stations, wherein the working stations have lower dies and upper dies cooperating to press workpieces and are arranged in a work-transferring direction, the transferring apparatus sequentially transferring the workpieces from the working stations to the succeeding working stations, said apparatus comprising:

a pair of guide bars extending in the transferring direction and mounted on opposite sides of the working stations;

means for providing an up-and-down movement of said pair of guide bars;

a pair of feed plates each supported on the corresponding guide bar;

means for providing movement of said pair of feed plates in the transferring direction relative to said corresponding guide bars;

carriages carried on each of the feed plates in correspondence to each of the work stations;

shift means associated with each of the carriages for shifting the carriage in the transferring direction relative to the feed plate;

cross bars each bridged over a pair of said carriages and capable of holding the workpiece;

said shift means varying, in the transferring direction, a movement of the carriages associated with at least one of the working stations relative to movement of the carriages associated with other of said working stations during operation of the transferring apparatus so that the workpieces can be transferred between working stations spaced different distances from one another.

2. The apparatus according to claim 1, wherein said cross bars are provided in a pair for each of the working stations and each pair are bridged commonly over a pair of carriages, said shift means being associated with each pair of carriages and capable of shifting at least one pair of carriages relative to other pairs of carriages on the feed plates.

3. The apparatus according to claim 2, further including means for moving each pair of cross bars relative to each other on the associated pair of carriages.

4. A transferring apparatus for a transfer press machine which includes a plurality of working stations, wherein the working stations have lower dies and upper dies cooperating to press workpieces and are arranged in a work-transferring direction, and the transferring apparatus sequentially transferring the workpieces from the working stations, said apparatus comprising:

a pair of guide bars extending in the transferring direction and fixedly mounted on opposite sides of the working stations;

a pair of feed plates each supported on the corresponding guide bar;

means for providing a movement of said pair of feed plates in the transferring direction relative to said corresponding guide bars;

carriages carried on the feed plates in correspondence to each of the working stations;

shift means associated with each of the carriages for shifting the carriages in the transferring direction relative to the feed plate;

cross bars each bridging a pair of said carriages;

means for providing an up-and-down movement of said cross bars relative to the carriages;

the shift means varying, in the transferring direction, a movement of the carriages associated with at least one of the working stations relative to a movement of the carriages associated with the other of the working stations during operation of the transferring apparatus so that the workpieces can be transferred between working stations spaced different distances from one another.

* * * * *